US007176414B1

(12) United States Patent
O'Donnell

(10) Patent No.: US 7,176,414 B1
(45) Date of Patent: Feb. 13, 2007

(54) GLOW PLUG

(76) Inventor: Steven B. O'Donnell, 10702 Hathaway Dr. #2, Santa Fe Springs, CA (US) 90670

( * ) Notice: Subject to any disclaimer, the term of this patent is extended or adjusted under 35 U.S.C. 154(b) by 158 days.

(21) Appl. No.: 10/781,279

(22) Filed: Feb. 17, 2004

Related U.S. Application Data

(63) Continuation-in-part of application No. 10/309,607, filed on Dec. 3, 2002, now Pat. No. 6,696,670.

(51) Int. Cl.
*F23Q 7/22* (2006.01)
*F23Q 7/00* (2006.01)

(52) U.S. Cl. ..... 219/270; 123/145 A

(58) Field of Classification Search ..... 219/267, 219/541, 544, 270; 123/145 A, 145 R
See application file for complete search history.

(56) References Cited

U.S. PATENT DOCUMENTS 4,080,944 A * 3/1978 Bhat et al. ..... 123/145 A
4,088,105 A * 5/1978 Bhat et al. ..... 123/145 A
4,418,661 A * 12/1983 Esper et al. ..... 123/145 A
4,582,981 A * 4/1986 Brooks et al. ..... 219/270
4,816,643 A * 3/1989 Zulauf et al. ..... 219/270
5,251,589 A * 10/1993 Duba et al. ..... 123/145 A
5,507,255 A * 4/1996 Boisvert et al. ..... 123/145 A
6,342,690 B1 * 1/2002 O'Donnell ..... 219/270
6,346,688 B1 2/2002 O'Donnell ..... 219/270

* cited by examiner

*Primary Examiner*—Daniel Robinson
(74) *Attorney, Agent, or Firm*—Edgar W. Averill, Jr.; Kenneth L. Green

(57) ABSTRACT

A glow plug having an outer body with an inner cavity having tapered sidewalls. An insulating ring having outer tapered walls is held within the body and has an inner opening also having tapered walls. A central electrode, having a tapered wall section, fits tightly in the inner opening of the insulating ring. The insulating ring and central electrode are forced under pressure in the cavity of the glow plug to provide a glow plug capable of withstanding high temperature and pressure applications without leaking.

8 Claims, 2 Drawing Sheets

GLOW PLUG

CROSS REFERENCE TO RELATED APPLICATIONS

This application is a continuation in part of applicant's application Ser. No. 10/309,607, filed Dec. 3, 2002 now U.S. Pat. No. 6,696,670.

BACKGROUND OF THE INVENTION

The field of the invention is glow plugs and the invention relates more particularly to a high performance glow plug for use in state of the art engines, particularly in model car engines.

Internal combustion model cars have been refined to an extent that tethered model cars can substantially exceed 200 mph. In such extreme environments the glow plugs are heated to a temperature where conventional glow plugs will leak and fail. Various improvements in glow plug construction have been made. One such improvement is shown in U.S. Pat. No. 6,346,688 having the same applicant as the present application. This patent is incorporated by reference herein.

Temperatures at the lower end of a glow plug can reach in excess of 1000° F. The combination of the pressure in the cylinder of the engine and the high temperature of the lower end of the glow plug can result in the formation of leaks which reduce the compression within the cylinder which is highly detrimental to the performance of the engine. A better seal against leaking can result when the crimping downward force is increased. However, the amount of force is limited by the strength of the plug body. Increased crimping force can deform the base of the plug and cause it to deform outwardly. Various attempts at improving the crimping at the top of the glow plug have reduced, but not eliminated, the problem. A better seal against leaking can result when the crimping downward force is increased. However, the amount of force is limited by the strength of the plug body. Increased crimping force can form the base of the plug and cause it to move outwardly.

BRIEF SUMMARY OF THE INVENTION

It is an object of the present invention to provide a glow plug which can withstand state of the art high performance temperatures and pressures without leaking.

The present invention is for a glow plug construction which has a larger than a conventional base to spread the crimping force over a greater area, thereby reducing the force per unit of base area. The glow plug body has a circumferential groove formed around the hexagonal portion of the body to permit the temporary attachment of an igniter.

DETAILED DESCRIPTION OF THE INVENTION

Figure 1:
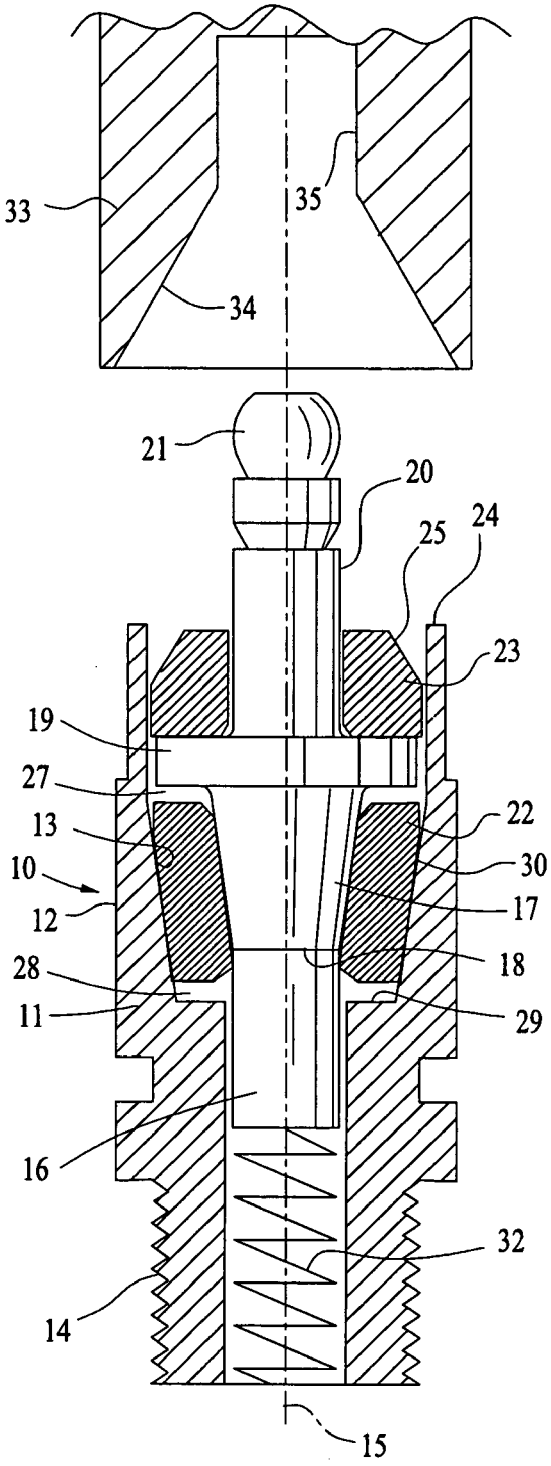
FIG. 1 is a cross-sectional view of the glow plug of the present invention prior to being crimped together taken along line 1—1 of FIG. 4.

A glow plug assembly prior to crimping is shown in FIG. 1 and indicated generally by reference character 10. Glow plug 10 has a body 11 which has an outer shell portion 12, which surrounds an inner cavity 13. The base of body 11 has a threaded portion 14, which would be screwed into an engine block in a conventional manner. Body 11 has a central axis 15 along which an inner electrode 16 is positioned.

Inner electrode 16 has a frusto-conical wall length 17, which extends upwardly from a base 18 to a washer 19. Washer 19 extends outwardly with respect to connector shaft 20. Washer 19 is preferably integrally formed with inner electrode 16.

Connector shaft 20 terminates in a connector for attachment to a source of electrical energy.

Figure 2:
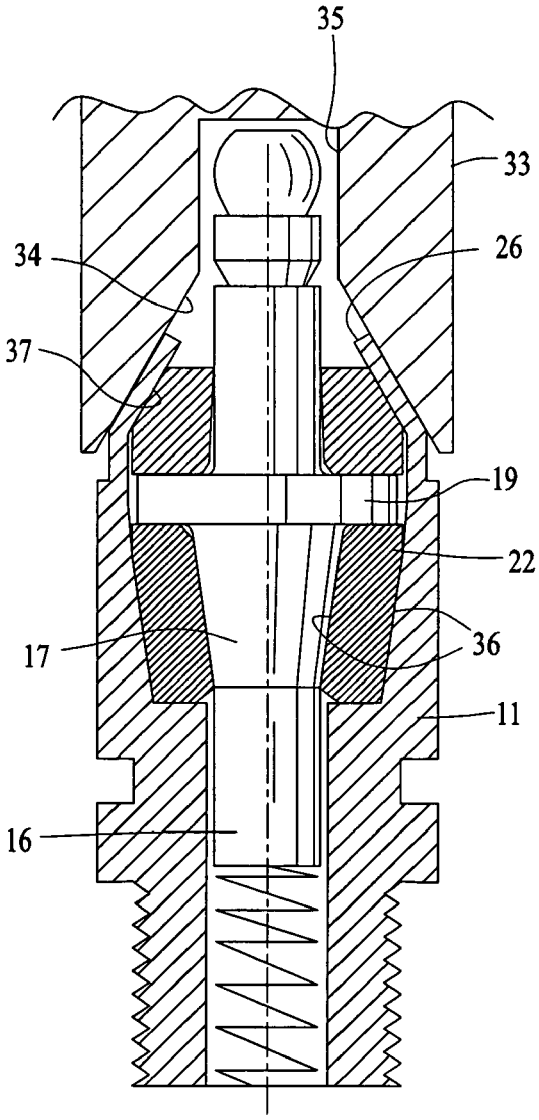
FIG. 2 is a cross-sectional view of the glow plug of the present invention after crimping.

Inner electrode 16 is held centrally in body 11 by a pair of insulated rings. Insulating ring 22 is fabricated from an electrically non-conductive material. One such material is hard anodized aluminum. All surfaces of ring 22 are anodized so that it does not conduct any electricity between inner electrode 16 and body 11. Similarly, an upper washer 23 is electrically non-conductive. It may also be made from hard anodized aluminum. Washer 23 is part of a pressure-applying portion of the assembly of FIG. 1. As shown in FIG. 2, upper ring 24 may be crimped against a frusto-conical portion 25, which is at an angle of, for instance, 30° with respect to central axis 15. The result is a continuous downward pressure formed by the contact between the crimped upper ring 26 and the frusto-conical portion 25 of upper washer 23.

As shown in FIG. 1, on initial assembly there is an upper gap 27 and a lower gap 28 between insulating ring 22 and washer 19 and lower floor 29, respectively. These gaps disappear during the crimping step as shown in FIG. 2. Preferably, castor oil is applied between the outer frusto-conical surface 30 and the inner cavity 13, as well as between the inner frusto-conical surface 31 of ring 22 and the frusto-conical wall length 17. Also, a light oil, such as that sold under the trademark "W-D 40," is preferably applied to the outer surface of upper washer 23 to help lubricate the downward compression movement of the parts to provide a glow plug such as that shown in FIG. 2. The glow plug in FIG. 2 has no gaps between the upper and lower surfaces of ring 22.

The heating element 32 is welded between the base of inner electrode 16 and body 11. The outer body is preferably fabricated from steel and the upper ring thereof 24 is moved inwardly by a crimping tool 33, which has a frusto-conical wall portion 34, and a connector opening 35. A downward pressure of 2500 to about 3000 pounds is preferably exerted, as shown in FIG. 2, which squeezes the inner electrode and the insulating ring downwardly until there is no significant gap above and below insulating ring 22, as shown in FIG. 2.

The frusto-conical angles relating to insulating ring 22 should be small enough so that they provide a locking taper. That is, when pressure is exerted downwardly on ring 22 in cavity 13, the angle is small enough so that the ring is locked into the cavity rather than simply falling out. This angle should be between 6° and 12°, and preferably about 8°. The presence of lubricant 36 and 37 helps to facilitate the elimination of gaps 27 and 28 during the crimping step. Also, it is believed that the use of castor oil at the area indicated by reference character 36 is further beneficial to prevent the escape of gases between ring 22 and either the body or the inner electrode. Castor oil, when sufficiently heated, will form a gummy residue which is believed to further enhance the sealing effect of the assembly under high temperatures.

Figure 3:
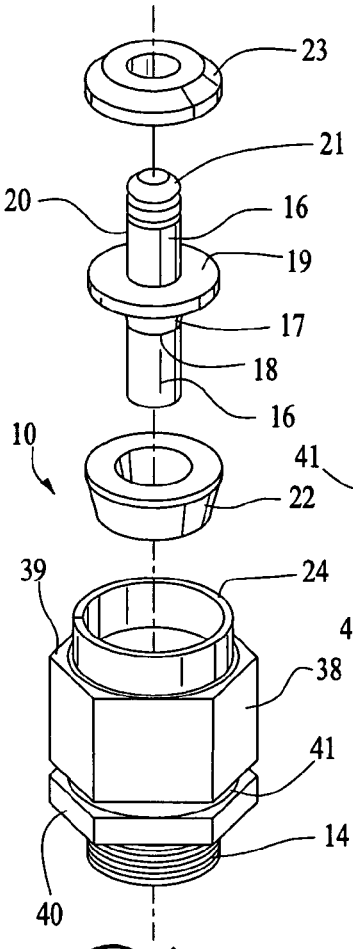
FIG. 3 is an exploded perspective view of the glow plug of FIG. 1.
Figure 4:
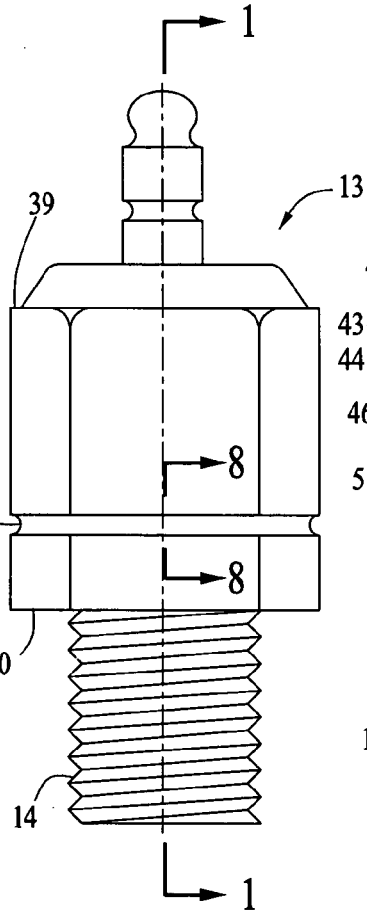
FIG. 4 is a side view of the plug of FIG. 1.
Figure 5:
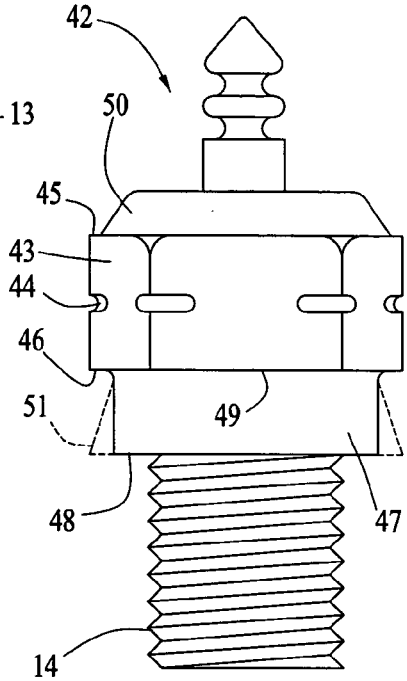
FIG. 5 PRIOR ART
FIG. 5 is a side view of a plug of the prior art.
Figure 8:
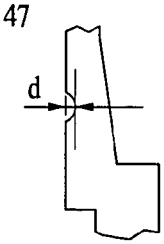
FIG. 8 is a cross-sectional view taken along line 8—8 of FIG. 4.

As can be seen in the prospective view of FIG. 3, glow plug 10 has a hexagonal portion 38 which extends from an upper end 39 to a base 40. The hexagonal portion is interrupted by a circumferential groove 41. Threaded portion 14 extends downwardly from base 40. Glow plug 13, after crimping is shown in side view in FIG. 4. A prior art glow plug 42 is shown in side view in FIG. 5. Glow plug 42 also has a hexagonal portion 43 and has a decorative circumferential groove 44. There is a substantial difference between grooves 41 and 44. As is visible from comparing FIGS. 4 and 5, circumferential groove 41 extends completely around the hexagonal portion. For instance, by viewing FIG. 8, it can be seen that groove 41 has a depth "d" in the middle of the hexagonal face in which it is located. In contrast, groove 44 shown in FIG. 5 has no depth at all in the center portion of the hexagonal faces. This groove 41 permits the attachment of an igniter. For a glow plug having a 5/16" hex, a groove having an inside diameter of 0.275" provides an appropriate depth for affixing of an igniter.

Hexagonal portion 43 extends from an upper end 45 to a lower end 46. A lower cylindrical portion 47 extends from lower end 46 to base 48. This forms a shelf 49 adjacent lower end 46. When the top of the plug is crimped, a downward force is exerted on the crimped portion of the plug, as shown in FIG. 2 of the drawings. An analogous force is placed on crimp 50 of plug 42. If the force reaches a sufficient level, base 48 is forced outwardly, as indicated by phantom line 51. This distortion prevents the exertion of additional force on crimp 50 and can limit the effectiveness of the sealing of the elements of the plug into a leak-free assembly.

Figure 6:
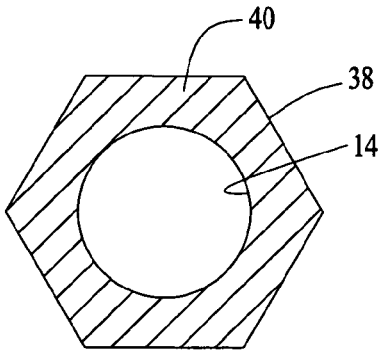
FIG. 6 is a bottom view of the plug of FIG. 4.
Figure 7:
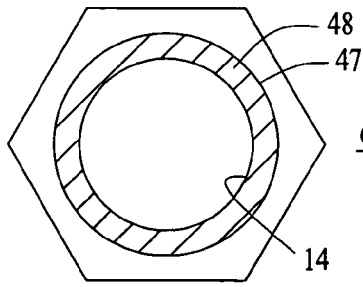
FIG. 7 is a bottom view of the plug of FIG. 5.

In order to decrease the tendency of the deformation indicated by phantom line 51, the area of the base has been increased, as shown best by comparing FIG. 6 with FIG. 7. In FIG. 6, the area for support of the plug during crimping is cross-hatched in FIG. 6 and exists essentially from the outer hexagonal portion 38 to the inner threaded portion 14. This cross-hatched area 48 is less than half of the area 40 shown in FIG. 6. It is, therefore, possible to exert a far greater crimping force without any distortion of the base of the plug. The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A glow plug comprising:

a body having a threaded portion for affixing the glow plug to an engine block, said body having an outer shell surrounding an inner cavity, said outer shell having a reduced portion at a top end of the outer shell, a center hexagonal portion having six faces, and the threaded portion extending downwardly from an engine block contactable base located at a bottom end of said hexagonal portion so that when said body is affixed to an engine block, the engine block contactable base contacts the engine block and forms a seal therewith, said engine block contactable base being formed in a horizontal plane when said plug is vertically oriented, and said hexagonal portion extending from the reduced portion to the threaded portion; and a circumferential groove formed horizontally in said outer shell in said hexagonal portion thereof and said circumferential groove extending completely across all six faces of said hexagonal portion and said hexagonal portion extending downwardly to terminate in contact with said engine block contactable base whereby the external shape of said base is hexagonal.

2. The glow plug of claim 1 wherein said hexagonal portion has an upper end and a lower end adjacent said base and said circumferential groove is located nearer said base than said upper end.

3. The glow plug of claim 1 wherein said hexagonal portion is a 5/16" hexagon and said peripheral groove has an inside diameter of about 0.275 inches.

4. The glow plug of claim 1 wherein reduced portion at a top end of the outer shell is a crimped portion.

5. A glow comprising:

an inner electrode;

a body residing around said inner electrode, said body comprising:

a reduced cross-section upper crimped portion for holding said center electrode in said body;

a lower threaded portion for affixing said glow plug to an engine;

a center hexagonal portion extending from said crimped portion to said threaded portion; and a circumferential groove extending continuously across all six faces of said hexagonal portion.

6. The glow plug of claim 5, wherein the upper crimped portion is reduced to have a cross-section less than a minor cross-section of said hexagonal portion.

7. The glow plug of claim 5, wherein the upper crimped portion is frusto-conical.

8. A glow plug body configured to assemble around a center electrode, the body comprising:

a cylindrical crimpable reduced cross-section upper portion for holding said center electrode in said body;

a lower threaded portion for affixing said glow plug body to an engine block;

a center hexagonal portion extending from said crimpable portion to said threaded portion; and a circumferential groove extending continuously across all six faces of said hexagonal portion.

* * * * *